United States Patent [19]

Brekke

[11] Patent Number: 4,915,215

[45] Date of Patent: Apr. 10, 1990

[54] CARD CARRIER DEVICE AND ATTACHMENT MECHANISM

[75] Inventor: Robert Brekke, Littleton, Colo.

[73] Assignees: Leo M. Oser; Betty Oser, both of Hamilton, Ind.

[21] Appl. No.: 182,789

[22] Filed: Apr. 18, 1988

[51] Int. Cl.[4] ..... A45C 11/18

[52] U.S. Cl. ..... 206/39; 206/39.5; 24/3 G; 24/3 L; 24/355; 150/147; 224/242; 224/252; 40/658

[58] Field of Search ..... 206/5, 39, 39.5; 24/3 G, 3 H, 3 L, 555; 150/147, 148; 224/151, 230, 242, 252, 269; 40/658, 666

[56] References Cited

U.S. PATENT DOCUMENTS

| | | | |
|---|---|---|---|
| 92,986 | 7/1889 | Metzgel | 206/39 |
| 1,338,702 | 5/1920 | Schrantz | 24/3 G |
| 1,415,276 | 5/1922 | Terner | 206/39.5 |
| 1,670,343 | 5/1928 | Clemens | 206/39.5 |
| 2,097,419 | 10/1937 | Schmidt | 24/555 |
| 3,250,448 | 5/1966 | Clark | 224/252 |
| 3,992,776 | 11/1976 | Koppe et al. | 224/252 |
| 4,148,422 | 4/1979 | Habler | 206/266 |
| 4,467,946 | 8/1984 | Brown | 224/252 |
| 4,784,199 | 11/1988 | Wise | 224/269 |

FOREIGN PATENT DOCUMENTS

| | | | |
|---|---|---|---|
| 2639990 | 3/1978 | Fed. Rep. of Germany | 224/252 |
| 823409 | 11/1959 | United Kingdom | 224/252 |

*Primary Examiner*—David T. Fidei

*Attorney, Agent, or Firm*—John L. Isaac

[57] ABSTRACT

A carrying case for business cards and the like, which case is securable to a piece of material, is disclosed. The case includes a body having first and second side members. The side members define a cavity therebeween which communicates with an opening at one end thereof. The body is sized and shaped to receive the cards through the opening into the cavity. An arrangement for accessing and removing the cards from the cavity includes a slot disposed along the first side member depending from one end toward the center portion of the first side member. A mechanism is provided for removably securing the case to the piece of material. Finally, an element projects from the interior surface of the second side member opposite the slot for constricting the width of the cavity along the center portion thereof to assist in maintaining the cards within the case while providing a leverage area for removal of the cards.

37 Claims, 4 Drawing Sheets

CARD CARRIER DEVICE AND ATTACHMENT MECHANISM

BACKGROUND OF THE INVENTION

1. Field of the Invention

The present invention relates generally to card holders and, more particularly, to portable cases for carrying business cards, credit cards and the like. Specifically, the present invention relates to card cases which are adapted for removable attachment to an article of clothing and the like and an improved attachment mechanism therefor.

2. Description of the Prior Art

Cases and carriers for business cards, credit cards and the like, are readily available in the art in various forms and designs. Such cases frequently include a card holder portion with a cover which closes to securely maintain the cards within the device. Such devices, while quite functional, are often cumbersome and bulky for fitting into one's pocket. Moreover, these devices require the use of both hands to remove the device from one's pocket and to then open the case to remove a card therefrom. It would be highly desirable to have such a card carrier device which would easily fit to a pocket flap or belt and would not readily lose cards from inadvertent spillage.

Another desirable feature for such a device would be one hand operation. More specifically, it would be a very desirable feature wherein a user could simply use one or two fingers of one hand to remove a card from its carrier without having to hold the device with the other hand. This feature would be especially attractive for salesmen and the like who may have one hand already occupied with holding materials. Without one hand operation, the user must put down whatever else he or she is carrying in order to free both hands to pull out and open the card holder.

U.S. Pat. Nos. 1,421,392, 1,553,066, 1,816,049 and 2,472,344 all disclose carrying cases having clips secured to the back thereof to permit attachment of the carrying case to a pocket or the like. However, these devices do not deal with cases designed for business cards, credit cards and the like. U.S. Pat. Nos. 1,284,320 and 1,713,760 also disclose carrying cases having a clip secured to one side thereof. While these cases have notches at the top to permit easy access to the article contained within the case, the articles disclosed are not cards but rather combs and the like. Moreover, these notches are located on both sides of the article within the case and simply provide easier access to the article. They do not assist in maintaining the article within the case.

U.S. Pat. Nos. 4,141,400 and 1,555,714 also disclose devices relating to the present invention. However, they too fail to provide a carrier device for business cards and credit cards which is easily and removably attachable to an article of clothing while simultaneously providing one hand operation in the removal of cards from the device. Thus there remains a need particularly in the business community for such a device which is also preferably flexible so that it is readily adaptable to a variety of applications. There is also a need for an attachment mechanism which provides increased security to prevent inadvertent loss of the case itself.

SUMMARY OF THE INVENTION

Accordingly, it is one object of the present invention to provide an improved card carrier device which is easily attachable to a user's clothing or belt.

It is another object of the invention to provide an improved card carrier device which is operable with the use of only one hand yet will securely hold the cards therewithin.

Another object of the present invention is to provide an improved card carrier device which includes an improved holding mechanism for the cards and which is adaptable to a variety of different kinds of cards and applications.

Yet another object of the present invention is to provide an improved attachment mechanism for card carriers, eyeglass cases and the like.

To achieve the foregoing and other objects and in accordance with the present invention, a carrying case is provided for business cards and the like which case is securable to a piece of material or fabric. The case includes a body having first and second side members. The side members define a cavity therebetween which communicates with an opening at one end thereof. The body is sized and shaped to receive the cards through the opening into the cavity. An arrangement is provided for accessing and removing the cards from the cavity and includes a slot disposed along the first side member depending from the one end toward the center portion of the first side member. A mechanism is also provided for removably securing the case to the piece of material. Finally, an element projects from the interior surface of the second side member opposite the slot for constricting the width of the cavity along the center portion thereof to assist in maintaining the cards within the case while providing a leverage area for removal of the cards.

BRIEF DESCRIPTION OF THE DRAWINGS

The features of the present invention which are believed to be novel are set forth with particularity in the appended claims. The invention, together with further objects and advantages thereof, may best be understood by reference to the following detailed description taken in conjunction with the accompanying drawings, in which:

DETAILED DESCRIPTION OF THE PREFERRED EMBODIMENTS

Figure 2:
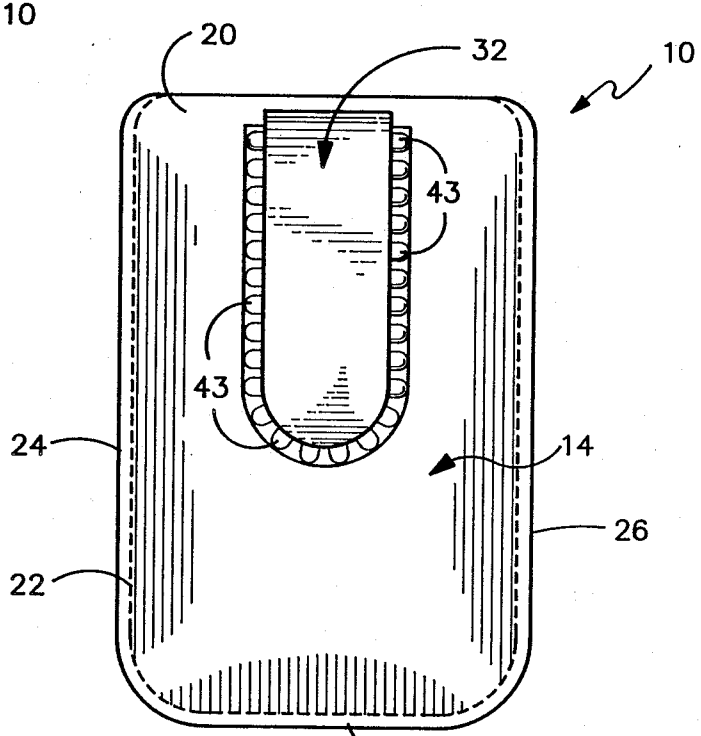
FIG. 2 is a rear view of the device illustrated in FIG. 1.
Figure 1:
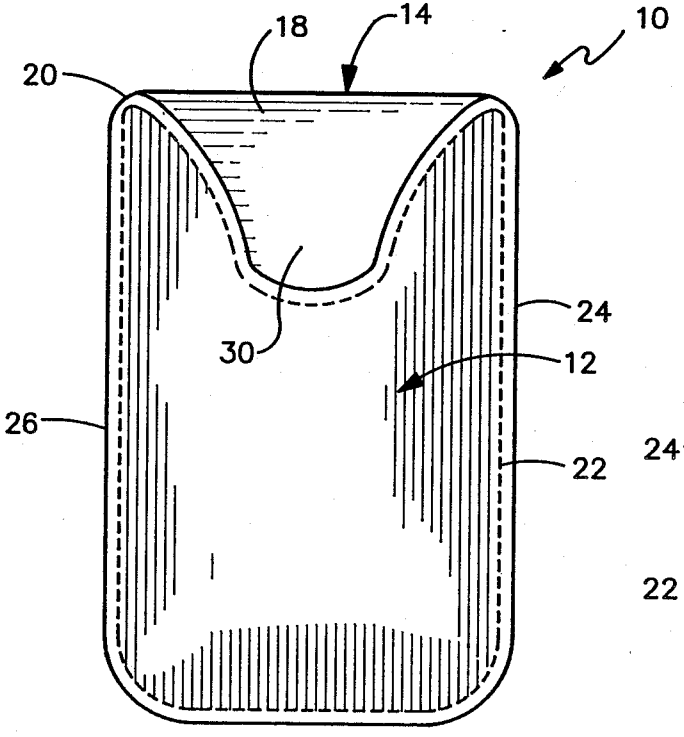
FIG. 1 is a front view of the carrier device constructed in accordance with the present invention.

Referring particularly to FIGS. 1–4, a carrier device or case 10 is shown and is adapted to receive and carry business cards, credit cards and the like. While the preferred embodiment of the invention is designed for use with such sized cards, it should be understood that the dimensions of the case 10 of the invention may be sized and shaped to receive and carry any type of card or similar item.

The body of the case 10 is formed by joining two similarly sized side members 12 and 14 which are attached to each other so as to define an interior cavity 16 therebetween. The cavity 16 is sized and shaped to receive business cards and the like therein through an opening 18 located at the top end 20 of the case 10. In preferred form, the side members 12, 14 are made from flexible fabric material such as vinyl, leather, denim and the like. In this instance, the flexible side members 12, 14 are connected together by stitching 22 along the side edges 24, 26 and the bottom end 28, leaving the top end 20 open for communication with the cavity 16. The respective interior surfaces 13, 15 of the side members 12, 14 are preferably lined with an appropriate scrim or velour lining to assist in card insertion and removal, although any desired material may be used.

A longitudinal slot 30 is preferably provided in the upper portion of the front side member 12 to provide access to cards placed within the case 10. More particularly, the slot 30 depends from the upper opening 18 at the top end 20 and preferably extends towards the center portion of the front member 12 approximately $\frac{1}{4}$ to $\frac{1}{3}$ the length of the case 10. The slot 30 is preferably in the form of a yoke or a rounded and outwardly flared "V". In this manner, the upper portion of a card disposed within the case 10 is readily accessible for removal from the case by using only one finger, preferably the thumb. In fact, a major advantage of the present invention is that the arrangment as described above permits one handed removal of cards from the carrier case 10, provided that the yoke slot 30 is sufficiently large to permit finger or thumb access to the cards.

The case 10 includes a mechanism for securing it to a piece of material such as the pocket flap of a shirt or coat, a belt, and the like. In this manner, the case 10 does not have to be carried in a pocket, purse, briefcase or the like which requires manipulation and use of both hands of a user. Instead, the case 10 can be easily and removably attached to a belt or other articles of clothing, and the user can easily obtain access to a card within the case 10 with the use of only one hand.

In one preferred form, the case attachment mechanism is in the form of a biasing device such as a spring clip 32. The clip 32 is attached at its upper end 33 to the upper portion of the exterior surface of the rear side member 14 and depends downwardly therefrom. The clip 32 includes a sloped tongue portion 34 which is preferably spring biased against the surface of the back member 14 and then terminates in a distal end 36 which is spaced from the surface of the back member 14. In an alternate embodiment, the tongue portion 34 may be slightly spaced from the surface of the back member 14 and adapted for exerting a biasing force toward the member 14 when moved away therefrom by the placement of fabric or other material between the member 14 and the clip 32. In this manner, fabric or a piece of material can be fed inbetween the distal end 36 and the member 14 and then slidingly fit between the tongue 34 and the member 14. The spring bias of the tongue 34 holds the material firmly in place. The upper portion 38 of the clip 32 is preferably in the form of a loop to permit material or a belt to be readily positioned therein. While the clip 32 may be constructed from any appropriate material, plastic is preferred.

Figure 7:
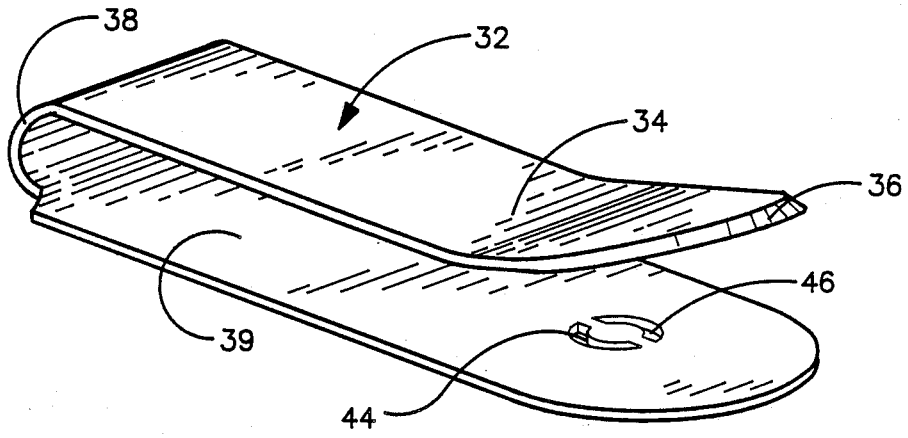
FIG. 7 is a front perspective view of a plastic clip member useful with the carrier device of the present invention.
Figure 8:
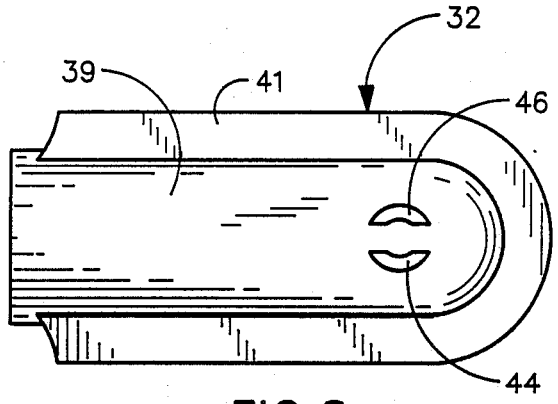
FIG. 8 is a bottom plan view of the clip member of FIG. 7.
Figure 9:
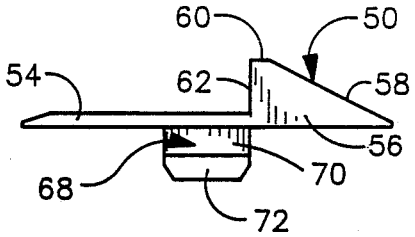
FIG. 9 is an enlarged side view of a stop member for use with the clip of FIG. 7.
Figure 10:
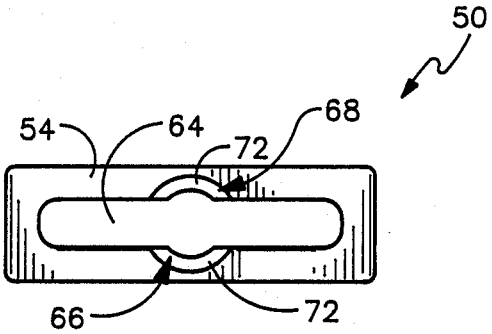
FIG. 10 is a bottom plan view of the stop member of FIG. 9.
Figure 11:
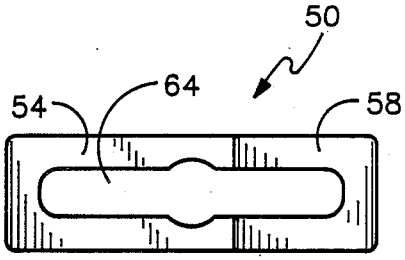
FIG. 11 is a top plan view of the stop member of FIG. 9.
Figure 12:
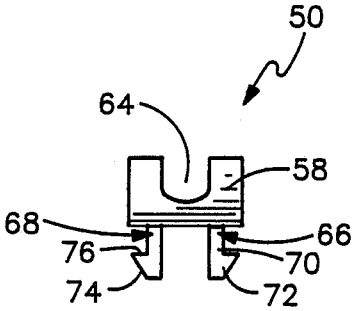
FIG. 12 is a front view of the stop member of FIG. 9.
Figure 13:
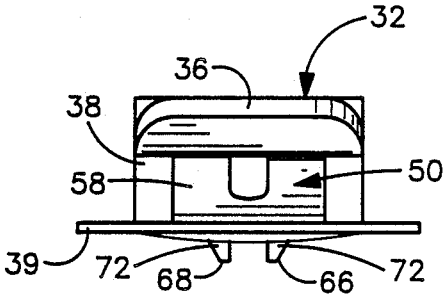
FIG. 13 is a front view of the combination of the stop member of FIG. 9 when engaged with the clip of FIG. 7.

Referring in particular to FIGS. 2, 7 and 8, one preferred form of the clip 32 includes a base member 39 which extends downwardly from the upper portion 38 along a line or plane in the same general direction to that of the tongue portion 34, although neither the base 39 nor the tongue 34 necessarily lie in a single plane. The base member 39 is preferably in the form of a substantially flat member intricately connected to the tongue 34 by way of the curved upper portion 38 and includes peripheral edge portions 41 disposed about both sides and the bottom distal end thereof. While the curved portion 38 may be directly attached to the back member 14 of the case 10, a preferred manner of attaching the clip 32 to the case 10 includes attachment of the base portion 39 to the surface of the back member 14 in any desired way. In one preferred embodiment, the base member 39 is sonic welded along its peripheral edges 41 to form a plurality of welds 43 to thereby attach the clip 32 to the back surface of the back member 14. By utilizing such a construction, the spring bias of the tongue portion 34 may be preset in relationship to the base 39 prior to clip attachment to a case 10 so that a simple sonic welding of the base 39 to the back member 14 will firmly attach the clip 32 in place with a predetermined bias already established in the tongue 34 relative to the base 39 and the case 10. As is also illustrated in FIGS. 7 and 8, a pair of curved apertures 44, 46 are provided in the base 39 for purposes to be described below.

Figure 5:
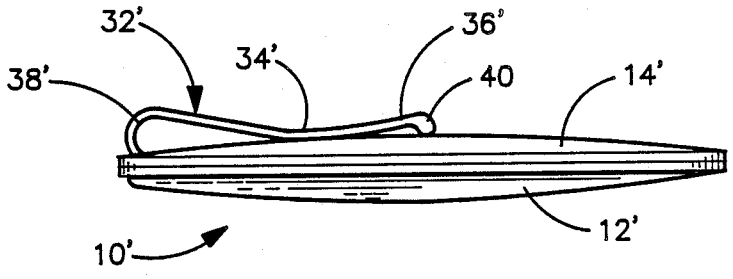
FIG. 5 is a side elevation similar to that of FIG. 4 but illustrating an alternate embodiment of the invention.

In an alternate form of the invention illustrated in FIG. 5, an end stop 40 is disposed at the distal end 36′ of the clip 32′. The end stop 40 is sized to be in contact with the surface of the member 14′ or base 39 if present. The end stop 40 prevents the inadvertent removal or sliding of the case 10′ from its position. In this manner, when the case 10′ is secured to a belt, for example, the belt fits entirely between the end stop 40 and the upper curved portion 38′ of the clip 32′, the end stop 40 preventing slippage of the case 10′ from its position over the belt. An alternate embodiment of this arrangement is discussed in greater detail below.

A raised portion in the preferred form of a raised ridge 42 is provided on the interior surface 44 of the side member 14. The ridge 42 is provided to assist in maintaining cards within the case 10 and to provide finger leverage when removing a card from the case 10. In preferred form, the raised ridge or portion 42 is positioned along the longitudinal axis of the case 10 opposite the slot 30 and extends approximately half the length of the case 10. The raised ridge 42 constricts the width of the cavity 18 at the center portion thereof to form a narrowed neck portion or area 46. This configuration assists in maintaining the cards in the cavity 18 by bending the cards slightly along their longitudinal length and thereby wedging them in the case 10. The raised portion 42 also provides a focal point for leverage when a user removes a card using only one hand. In this manner, a user's thumb can be placed on a card in the case 10 over the slot 30 with the forefinger of the same hand being placed against the clip 32, and pressure from the thumb can be exerted against the card in the case 10 and the raised ridge 42 to leverage against the card and assist in the removal thereof from the case 10.

Figure 3:
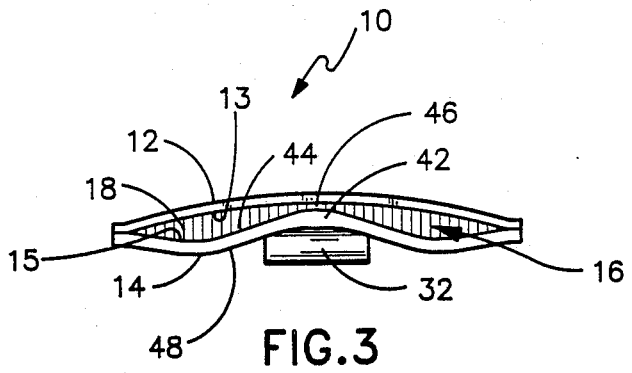
FIG. 3 is a top plan view of the device of FIG. 1.
Figure 4:
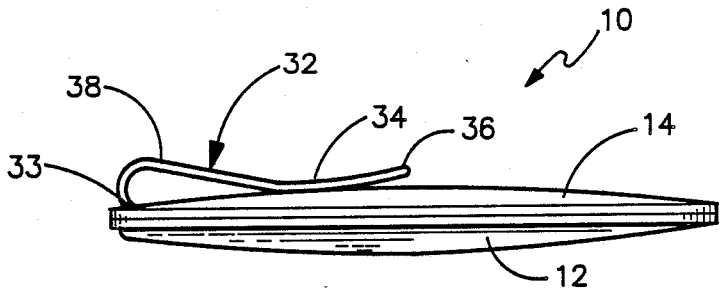
FIG. 4 is a side elevation of the device of FIG. 1.

While the raised ridge may be formed in any desired fashion, a preferred form of construction includes the use of a plastic clip 32 which is attached and preferably sonic welded to the surface of the member 14 as described above. In so welding the clip 32, it can be formed in such a manner as to cause a deformation of the side member 14 to thereby form the raised ridge 42 along the interior surface 15 thereof. Another advantage in forming the case 10 of the invention in this manner is that the clip 32 forms a depression 48 in the exterior surface of member 14 which tends to reduce the projection of clip 32 from the exterior surface of the side member 14 as illustrated in FIG. 3. This depression 48 also assists in maintaining the case 10 in a firm position when secured to a pocket flap, a belt or the like.

Figure 6:
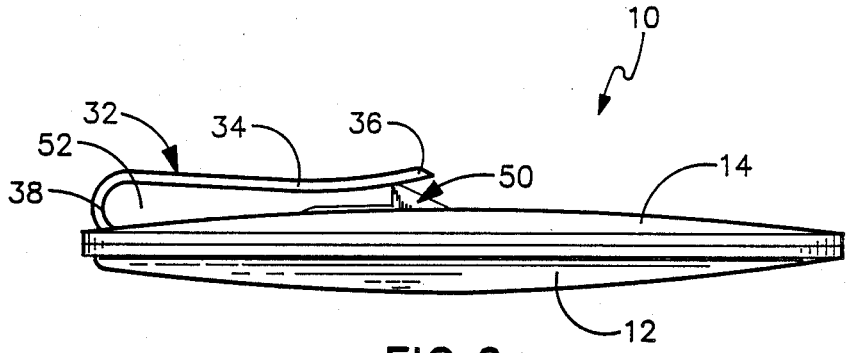
FIG. 6 is a side elevation similar to those of FIGS. 4 and 5 but illustrating yet another embodiment of the invention.

Referring now to FIGS. 6–13, yet another embodiment of the invention is illustrated having an improved attachment mechanism. The case 10 includes the front side member 12 and the rear side member 14 as previously described. Moreover, the clip 32 as illustrated in FIG. 7 and described above is secured to the rear surface of the back member 14 as illustrated in FIG. 6. An end stop member 50 is provided for selective attachment to the clip 32. The end stop member 50 functions in a manner similar to the end stop member 40 of FIG. 5. However, the member 50 is a separate unit and is selectively attachable to the clip 32 to permit the user of the case 10 to determine whether he or she wishes to have such an end stop member 50 attached thereto. For example, if the ultimate user of the case 10 intends to secure the case 10 to a belt, the end stop member 50 is particularly useful in such applications so that the belt would then be maintained within the area 52 defined by the clip 32 and end stop member 50. If one does not intend to clip the case 10 to a belt or similar type of item, one need not attach the end stop member 50 so that the clip 32 will function as previously described and illustrated in FIG. 4. In this manner, the end user of the case 10 will have an option depending on the desired use of the case 10. Moreover, the end stop member 50 is useful with the clip 32 in other applications such as with eyeglass cases and the like, so that the attachment mechanism represented by the clip 32 of FIG. 7 and the end stop member 50 has much broader application than merely card carrying cases as described in the embodiments illustrated in FIGS. 1–5.

Referring to the attachment mechanism in more detail, the end stop member 50 is a unitary body preferably made from plastic and includes a planer plate 54 which is designed to lay flat on the surface of the base member 39 of the clip 32. The plate 54 includes a raised stop portion 56 at the front end thereof. The stop portion 56 includes an inclined face 58 which terminates in a small ledge 60 substantially parallel to the plate 54. A shoulder 62 is provided and extends downwardly from the ledge 60 substantially perpendicular to the plate 54. As can be seen from FIG. 6, the inclined face 58 is provided to permit easy insertion of fabric or a belt into the clip 32 since the distal end 36 of the clip 32 rests on the ledge 60. Once the fabric or belt is within the area 52 of the clip 32, the shoulder 62 helps maintain and retain the belt or fabric within the area 52 and prevents inadvertent dislodgement of the case 10 from the belt or similar material. When it is desired to remove the case 10 from the belt or fabric, a simple raising of the end portion 36 of the clip 32 separates the clip 32 from the ledge 60 enables the belt or fabric to be readily removed from the area 52 to disconnect the case 10 therefrom.

Referring particularly to FIGS. 9–12, an elongated slot 64 is preferably provided in the central portion of the plate 54 and the raised member 56 to reduce the amount of material necessary to manufacture the end stop 50 as well as to enable easy manufacture of the connecting mechanism to be described below. A pair of connecting members 66, 68 depend downwardly from the bottom surface of the plate 54 at the central portion thereof. The shape of the connecting members 66, 68 matches the shape of the apertures 44, 46 in the bottom portion 39 of the clip 32 to permit insertion therethrough. Each connecting member 66, 68 includes a post or pin portion 70 which extends downwardly from the plate 54 and terminates in an enlarged end portion 72 having a beveled face 74 terminating in a shoulder 76 substantially parallel to the plate 54. The connecting members 66, 68 are preferably constructed from plastic or similar material having some resiliency so that as the members 66, 68 are press-fit through the aperture 44, 46, they are forced slightly inwardly toward each other due to the beveled faces 74. Once the end members 72 have passed entirely through the apertures 44, 46, the connecting members 66, 68 spring outwardly so as to abut the shoulders 76 against the bottom surface of the base member 39 of the clip 32. The shoulders 76 prevent removal of the end stop 50 from the apertures 44, 46 unless the connecting members 66, 68 are pressed inwardly toward each other to disengage the shoulders 76 and align the end members 72 with the apertures 44, 46.

As can be seen from FIG. 6, once the base 39 of the clip 32 is firmly sonic welded to the back member 14, access to the connecting members 66, 68 is virtually impossible after the end stop 50 is press fitted through the apertures 44, 46. Thus, it is generally intended that the end stop 50 be a permanent attachment to the clip 32 if desired by the end user. In this manner, the end stop 50 will not inadvertently fall out or be pulled out by force against a belt or other fabric within the area 52 since the end stop 50 is securely attached to the back member 39 of the clip 32 in the manner described above.

As will be appreciated, the attachment mechanism afforded by the clip 32 of FIG. 7 and the separately attachable end stop 50 has much broader applications than card carrying cases. Any type of leather or vinyl carrying case such as for eyeglasses and the like which have traditionally included back clips such as the clip 32 may be adapted to permit the selective use of an end stop 50 by the ultimate user, thereby providing the user with choices depending on personal use and preference. Since inadvertent loss of eyeglass cases, carrying cases as in the present invention, and the like have traditionally been a problem over the past, the attachment mechanism afforded by the present invention has a distinct advantage and improvement over the prior art. It should also be noted that by interjecting the raised member 56 between the distal end 36 of the clip 32 and the bottom member 39 of the clip 32, the clip 32 is placed into a biased condition so that the end 36 is firmly and continuously pressed against the ledge 60 of the member 50. Thus, should the user of the case 10 choose to insert the end stop 50 as described above, and then wish to use the case 10 by attaching it to a fabric such as a pocket flap, the end stop member 50 will add additional security by insuring a tight biasing force between the clip 32 and end stop 50 to securely hold any fabric that is inserted therebetween. Thus, the use of the end stop 50 with the clip 32 provides multiple security uses.

As can be seen from the above, a unique card carrier device is provided. The carrier case of the present invention permits easy access to the cards carried therein by allowing one-handed operation and removal of cards. This feature is particularly helpful for salemen and the like who frequently are carrying items such as a briefcase with one hand while simultaneously attempting to retrieve a business card to hand to a customer or the like. The arrangement of the present invention also firmly maintains the cards within the case, which feature is particularly important since the case is an open-ended case with the cards therein exposed. Without such firm card maintenance, the cards would tend to fall out of the case. Another feature of the invention is the high visibility afforded the cards in the case as opposed to prior art cases with covers. Such high visibility increases the awareness of the user as to any need for resupply of cards in the case, thus assuring that the user will not be caught without any cards. Finally, the present invention permits easy yet firm attachment thereof to the clothing or belt of a user without worry of loss of the case or the cards within the case. In conjunction with such firm attachment, an improved attachment mechanism is provided by the present invention which enables the end user to determine if additional security is needed depending on the desired use of the case as well as other carrying cases such as for eyeglasses.

It will be understood that the foregoing description of the invention may be embodied in other specific forms without departing from the spirit or central characteristics thereof. The present examples and embodiments, therefore, are considered in all respects as exemplary only and that the scope of the present invention is to be limited only to the appended claims as interpreted in view of the prior art.

I claim:

1. A carrying case for business cards and the like securable to a piece of material or fabric, said case comprising:

a flexible body having first and second side members defining a cavity therebetween communicating with an opening at one end thereof, said body being sized and shaped to receive said cards through said opening into said cavity;

means for accessing and removing said cards from said cavity including a slot disposed along said first side member depending from said one end toward the center portion of said first side member;

means for removably securing said case to said piece of material; and means in the form of a fixed raised ridge projecting from the interior surface of said second side member opposite said slot to create a narrowed neck portion at the center of said cavity for constricting the width of said cavity along the center portion thereof to assist in maintaining said cards within said case while providing a leverage area for removal of said cards.

2. The case as claimed in claim 1, wherein said raised ridge is disposed along the longitudinal axis of said case.

3. The case as claimed in claim 2, wherein said raised ridge extends approximately half the length of said case along the longitudinal axis thereof.

4. The case as claimed in claim 1, wherein said raised ridge is created by inward deformation of said body by said securing means.

5. The case as claimed in claim 1, wherein said raised ridge is sized and shaped to compress said cards between said raised ridge and said first side member.

6. The case as claimed in claim 1, wherein said slot is in the form of a yoke to permit finger access to the surface of the cards disposed within said cavity.

7. The case as claimed in claim 1, wherein said first and second side members comprise a pair of flexible members secured together along two longitudinal edges and a bottom end to create said cavity therebetween, the top end remaining open to communicate with and provide exterior access to said cavity.

8. The case as claimed in claim 7, wherein said flexible members comprise a fabric material stitched together along said edges and bottom end.

9. The case as claimed in claim 8, wherein the interior surfaces of said side members are covered with material adapted to enhance movement of said cards into and out of said cavity.

10. The case as claimed in claim 1, wherein said securing means comprises a bias member adapted to secure said material between said bias member and said case.

11. The case as claimed in claim 10, wherein said bias member is disposed on the exterior surface of said second side member and is adapted to slidingly engage and secure said case to said material.

12. The case as claimed in claim 11, wherein said bias member comprises a spring clip.

13. The case as claimed in claim 12, wherein said spring clip includes end stop means to prevent inadvertent detachment of said case from said material.

14. The case as claimed in claim 13, wherein said end stop means is disposed at the distal end of said clip.

15. The case as claimed in claim 13, wherein said end stop means comprises a raised member selectively attachable at the exterior surface of said second side member and biased against the distal end of said clip.

16. The case as claimed in claim 11, wherein said bias member is secured to said second side member to create said raised ridge.

17. The case as claimed in claim 16, wherein said bias means is constructed from plastic and is sonic welded onto said second side member.

18. A card holder for carrying business cards, credit cards and the like, and removably securable to a flat piece of material such as a pocket flap, belt and the like, said holder comprising:

a pair of flexible fabric members each having side edges, a top end and a bottom end, said fabric members being attached to each other along said side edges and said bottom ends to define a central cavity therebetween communicating through an end opening defined at said top ends;

a longitudinal slot disposed in a first of said fabric members and extending from said top end toward the central portion of said first fabric member, said slot defining an access opening to said cavity to enable said cards to be accessed and removed;

spring bias means disposed on the second of said fabric members and adapted to permit selective attachment of said holder to said material; and a fixed raised ridge portion disposed on the interior surface of said second fabric member opposite said slot to create a narrowed neck portion at the center of said cavity by narrowing the width of said cavity to press and firmly hold said cards within said cavity between said raised ridge portion and said first fabric member.

19. The holder as claimed in claim 18, wherein said raised ridge portion is aligned along the longitudinal axis of said holder and extends approximately half the length of said holder.

20. The holder as claimed in claim 19, wherein said raised ridge portion is positioned on the side of the second fabric member opposite from said spring bias means.

21. The holder as claimed in claim 18, wherein said spring bias means includes end stop means disposed proximate the distal end thereof to prevent unintentional removal of said holder from said material.

22. The holder as claimed in claim 21, wherein said end stop means is selectively attachable to said spring bias means.

23. The holder as claimed in claim 18, wherein said spring bias means comprises a spring clip having a sloped clamping tongue biased toward the exterior surface of said second fabric member to permit attachment of said holder to said material.

24. The holder as claimed in claim 23, wherein said spring bias means includes an end stop member selectively attachable to said spring clip to bias against the distal end of said clamping tongue and thereby firmly hold any material positioned therebetween.

25. The holder as claimed in claim 18, wherein said slot is in the form of a yoke exposing the upper portion of said cards to permit one finger removal of cards from said holder, said raised ridge portion providing a leverage point during such removal.

26. The holder as claimed in claim 18, wherein said fabric members are made from material selected from the group consisting of vinyl, leather and denim.

27. A business card holder selectively attachable to a flat surface such as a pocket, a belt and the like, said holder comprising:

a pair of substantially rectangularly-shaped pieces of fabric each having longitudinal side edge, a top end and a bottom end, said fabric pieces being stitched together along said side edges and said bottom ends to form an interior cavity sized and shaped to receive said cards therein through an opening formed at the top end thereof;

a yoke-shaped slot disposed in the upper portion of a first fabric piece and depending from the top end of said holder toward the center of said fabric piece to provide finger access to the cards disposed within said cavity;

a spring clip secured onto the surface of the second fabric piece and having a sloped tongue biased toward the surface of said second piece to provide a means for slidingly engaging and securely maintaining said holder against said flat surface; and a raised ridge projecting from the interior surface of said second fabric piece and formed by the inward deformation of said second fabric piece resulting from the attachment of said spring clip to said second fabric piece, said raised ridge creating a narrowed neck portion at the center of said cavity to press against and slightly bend the cards disposed within said cavity to maintain said cards securely therewithin.

28. An attachment mechanism for a carrying case and the like, said attachment mechanism comprising:

a biasing member securable to said case and including a tongue portion spaced at least in part from and biased toward said case when secured thereto; and end stop means selectively attachable to said biasing member for biased contact with said tongue portion when attached to said biasing member.

29. The attachment mechanism as claimed in claim 28, wherein said biasing member comprises a spring clip having a free, distal end.

30. The attachment mechanism as claimed in claim 29, wherein said end stop means comprises a member adapted for bias contact with the free end of said spring clip when attached to said clip to provide a pair of biased surfaces adapted to press fit against anything selectively disposed therebetween.

31. The attachment mechanism as claimed in claim 30, wherein said spring clip includes a base member integral with said tongue portion and attachable to said case to position said tongue portion in a spaced relationship to said case.

32. The attachment mechanism as claimed in claim 31, wherein said base member includes a pair of apertures adapted to receive said end stop member.

33. The attachment mechanism as claimed in claim 32, wherein said end stop member includes a shoulder portion to prevent inadvertent removal of material positioned between said tongue and base member.

34. The attachment mechanism as claimed in claim 33, wherein said end stop member further includes a front beveled surface opposite said shoulder portion, said beveled surface being adapted to enhance insertion of material between said tongue portion and said base member.

35. An attachment security device for use with a spring clip mechanism, said security device providing an end stop in conjunction with said spring clip mechanism wherein said spring clip mechanism includes a base member and a tongue member integral with said base member and spaced from yet biased toward said base member, said tongue member having a distal free end, said security device comprising:

a unitary body including a mounting plate, attachment means projecting downwardly from one surface of said mounting plate and adapted for attachment to one member of said spring clip, and a raised portion extending upwardly from the opposite surface of said mounting plate and adapted to engage the opposite member of said spring clip when said attachment means is secured to said spring clip, said raised portion including a front beveled surface extending upwardly from said mounting plate to enhance insertion of material between said security device and said spring clip, and a shoulder portion aligned substantially perpendicular to said mounting plate and connecting the upper end of said beveled surface and said mounting plate to provide an end stop for material positioned between the base and tongue members of said spring clip.

36. The security device as claimed in claim 35, wherein said attachment means includes a pair of prongs projecting from said mounting plate and adapted for engagement with and through a corresponding pair of apertures disposed in said spring clip base member, said prongs being resilient and including shoulders formed from inclined surfaces for secure attachment of said prongs to said spring clip base.

37. The security device as claimed in claim 36, wherein said raised portion further includes a ledge at the upper surface thereof which defines the upper end of said unitary body shoulder and the upper end of said unitary body front beveled surface, said ledge functioning as a biasing surface for engagement with the tongue member of said spring clip.

* * * * *